US005201824A

United States Patent [19]

Kato et al.

[11] Patent Number: 5,201,824

[45] Date of Patent: Apr. 13, 1993

[54] PUSH BUTTON SWITCH

[75] Inventors: Takafumi Kato, Tamari; Kazutoshi Watanabe, Iwaki, both of Japan

[73] Assignee: Alps Electric Co., Ltd., Tokyo, Japan

[21] Appl. No.: 820,451

[22] Filed: Jan. 13, 1992

Related U.S. Application Data

[62] Division of Ser. No. 584,558, Sep. 18, 1990, Pat. No. 5,120,932.

[30] Foreign Application Priority Data

Oct. 6, 1989 [JP] Japan ..... 1-117693
Dec. 22, 1989 [JP] Japan ..... 1-331150

[51] Int. Cl.[5] ..... H01H 17/28

[52] U.S. Cl. ..... 200/520; 200/341; 200/344; 200/345; 200/521

[58] Field of Search ..... 141/517, 520, 521, 341-344, 141/345

[56] References Cited

U.S. PATENT DOCUMENTS

| | | | |
|---|---|---|---|
| 3,773,997 | 11/1973 | Evans et al. | 200/517 |
| 3,777,090 | 12/1973 | Muller | 200/517 |
| 3,829,672 | 8/1974 | Klehm, Jr. | 200/517 X |
| 3,856,998 | 12/1974 | Sims, Jr. | 200/517 X |
| 4,164,634 | 8/1979 | Gilano | 200/517 X |
| 4,467,160 | 8/1984 | Murmann et al. | 200/576 |
| 4,733,036 | 3/1988 | Kolzumi et al. | 200/517 |
| 4,927,990 | 5/1990 | Aoki et al. | 200/517 |
| 5,034,573 | 7/1991 | Bonmassari et al. | 200/517 X |
| 5,120,923 | 6/1992 | Kato et al. | 200/520 |

FOREIGN PATENT DOCUMENTS

| | | | |
|---|---|---|---|
| 0264125 | 10/1989 | Japan | 200/517 |
| 0119620 | 5/1991 | Japan | 200/517 |
| 0155013 | 7/1991 | Japan | 200/517 |

*Primary Examiner*—Ernest G. Cusick
*Attorney, Agent, or Firm*—Guy W. Shoup; B. Noel Kivlin; Norman R. Klivans

[57] ABSTRACT

A push button switch including a case, a key top fastened to the case, an elastic member disposed between the case and the key top and acting to upwards urge the key top and a contact portioned so as to confront a spring member fastened to an operation member of the key top so that the contact portion is pressed by the spring member when the key top is depressed, the push button switch comprising: a movable member disposed between the operation member of the key top and a projection wall of the case whereby the operation member and the movable member can be moved with respect to each other and the movable member and the projection wall can be moved with respect to each other.

7 Claims, 6 Drawing Sheets

PUSH BUTTON SWITCH

This application is a division of application Ser. No. 07/584,558, filed Sept. 18, 1990, U.S. Pat. No. 5,120,932.

BACKGROUND OF THE INVENTION

1. Field of the Invention

The present invention relates to a push button switch for use as a key switch for a data input apparatus for a personal computer, a word processor or the like, and, more particularly, to a push button switch the thickness of which can be easily reduced.

2. Related Art Statement

A conventional push button switch of the type described above will be described with reference to FIG. 13.

Referring to the drawing, reference numeral 1 represents a reinforcing plate made of metal or the like. A membrane switch 2, comprising an upper sheet 2b having a movable contact 2a and a lower sheet 2d having a fixed contact 2c, is placed on the reinforcing plate 1. A case 3 is placed on the membrane switch 2, the case 3 having an annular first projecting portion 3a and a second projecting portion 3b. An operation member 4a of a key top 4 is movably positioned along an inner surface 3c of the first projecting portion 3a. the operation member 4a has a fastening claw at the lower end portion thereof so that the fastening claw is fitted within a recessed portion (omitted from illustration) formed in the first projecting portion 3a. As a result, the fastening claw can be moved within the recessed portion and the operation member 4a can be vertically moved along the inner surface 3c. Furthermore, a coil spring 5 is interposed between a flat surface 3d of the case 3 and the lower surface of the key top 4 in such a manner that the coil spring 5 is positioned around the first projecting portion 3a. In addition, another coil spring 6 is positioned in the operation member 4a by pressfitting for the purpose of pressing the movable contact 2a of the membrane switch 2. Although omitted from the illustration in FIG. 13, a recessed portion is formed in the second projecting portion 3b in a direction perpendicular to the direction of the drawing sheet for FIG. 13. As a result, the upward separation of the key top 4 is prevented by fastening the fastening claw provided for the key top 4 to the recessed portion.

Thus, when the key top 4 is depressed against the urging force of the coil spring 6, the outer portion of the operation member 4a is downwards moved along the inner surface 3c. As a result, the lower end portion of the coil spring 5 press-fitted in the operation member 4a presses the upper sheet 2b of the membrane switch 2, causing the movable contact 2a to be brought into contact with the fixed contact 2b. Therefore, the switch is switched on. When the pressure applied to the key top 4 is then released, the original state can be restored by the elastic restoring force of the coil spring 6.

Recently, there has been a desire for a compact keyboard having a reduced thickness, causing a necessity for reducing the thickness of the push button switch to arise.

When a push button switch having a reduced thickness is constituted, the push button switch must have a certain depressing stroke (3 to 4 mm).

It is assumed that the thickness of the key top 4 is b, the distance of the movement of the key top 4 is S, the length of a portion (omitted from illustration) for fastening the case 3 and the key top 4 is a, the thickness of the reinforcing plate 1 and the membrane switch 2 is c and the overall height is expressed by H.

Then, the length a of the fastening portion can be expressed by $a=H-(2S+b+c)$. In this case, the thickness b of the key top 4, the movement distance S of the key top 4 and the thickness c of the membrane switch 2 and the reinforcing plate 1 become substantially constant depending upon the molding condition and the parts composition. Therefore, there has conventionally been a necessity for the length a of the fastening portion to be shortened at the time of realizing the above-described thickness reduction.

However, if the length a of the fastening portion is shortened, the lower end portion of the operation member 4a of the key top 4 is caught by the inner surface of the first projecting wall 3a of the case 1 when the end portion A of the key top 4 is depressed. As a result, the conventional push button switch cannot be depressed smoothly.

SUMMARY OF THE INVENTION

Accordingly, an object of the present invention is to provide a push button switch which is able to overcome the above-described technical problem and which can be depressed smoothly.

A push button switch of the type described above has been arranged in such a manner that the key top 4 can be held by the housing so as to be capable of upwards/-downwards movement by inserting and bringing the stem 4a into contact with the inner surface 3c of the guide cylinder 3a. Therefore, an attempt has been made in that the height of the guide cylinder 3a is shortened for the purpose of reducing the thickness of the push button switch with maintaining a desired operation stroke. However, the length of the insertion of the stem 4a into the guide cylinder 3a inevitably becomes too short. As a result, the key top 4 may be easily inclined with respect to the housing 3 due to the small clearance necessary when the key top 4 is moved with respect to the housing. In particular, when an operator presses the edge of the key top 4, the stem 4a may be caught by the guide cylinder 3a. As a result, the push button switch cannot be smoothly depressed.

Accordingly, another object of the present invention is to provide a push button switch capable of overcoming the above-described technical problem, reducing the size and the thickness thereof and having a key top which can be smoothly depressed.

In order to achieve the above-described objects, a first aspect of the present invention lies in a push button switch including a case, a key top fastened to the case, and an elastic member disposed between the case and the key top and acting to upwards urge the key top and a contact portion positioned so as to confront a spring member fastened to an operation member of the key top so that the contact portion is pressed by the spring member when the key top is depressed, the push button switch comprising: a movable member disposed between the operation member of the key top and a projection wall of the case whereby the operation member and the movable member can be moved with respect to each other and the movable member and the projection wall can be moved with respect to each other.

A second aspect of the present invention lies in a push button switch including a housing having a guide cylinder, a key top having a stem and a restoring member disposed between the housing and the key top so that the contact is switched by upwards or downwards movement of the stem along the guide cylinder, the push button switch comprising: an actuator disposed between the guide cylinder and the stem in such a manner that the actuator is able to move with respect to the guide cylinder and the stem, whereby the contact is depressed by the actuator.

As described above, the push button according to the present invention is constituted in such a manner that the movable member is disposed between the operation member of the key top and the first projecting wall of the case. Therefore, the length of the portion for connecting the key top and the movable member and that for connecting the movable member and the case can be lengthened by the half of the distance of the movement in comparison to the conventional structure in which no movable member is provided assuming that the height of the push button is the same.

Furthermore, according to the above-described structure, the actuator moves with respect to the guide cylinder and the stem when the key top is depressed. Therefore, the height of the guide cylinder can be reduced without the necessity of shortening the distance of the movement. Furthermore, the contact can be pressed by the thus disposed actuator. Therefore, the diameter of the guide cylinder can be reduced.

Other and further objects, features and advantages of the invention will be appear more fully from the following description.

BRIEF DESCRIPTION OF THE DRAWINGS

FIGS. 1 and 2 respectively illustrate a first embodiment of the present invention, wherein FIG. 1 is a cross sectional view which illustrates an essential portion of a push button switch according to the present invention;

FIG. 2 is a cross sectional view which illustrates the push button switch shown in FIG. 1 when viewed from another side direction;

FIGS. 9 to 12 respectively illustrate a fourth embodiment of the present invention, wherein FIGS. 9 and 10 are cross sectional views which respectively illustrate the push button switch in a nonoperated state when viewed from different directions;

FIG. 11 is a cross sectional view which illustrates the push button switch in a depressed state;

FIG. 12 is a perspective view which illustrates the actuator; and

DETAILED DESCRIPTION OF THE PREFERRED EMBODIMENTS

A first embodiment of the present invention will not be described with reference to FIGS. 1 and 2.

Figure 1:
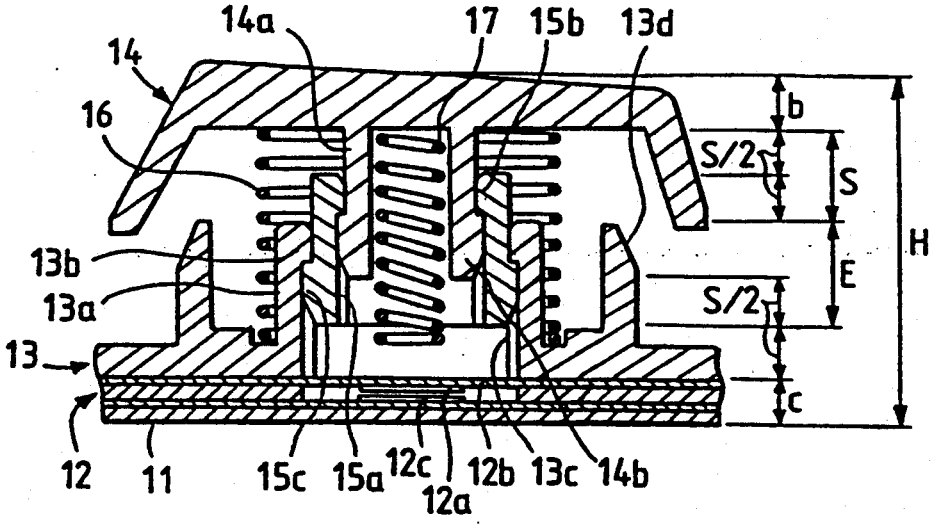
Figure 2:
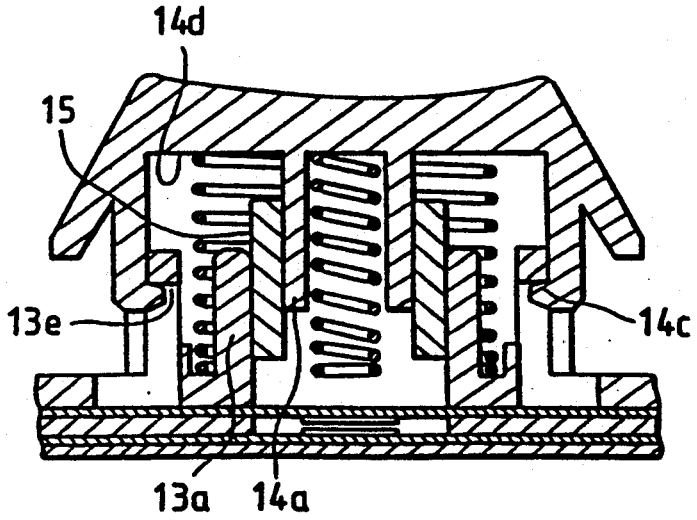

FIG. 1 is a cross sectional view which illustrates an essential portion of a push button switch according to the present invention. FIG. 2 is a cross sectional view which illustrates an essential portion of the push button switch shown in FIG. 1 when viewed from another direction.

Referring to the drawings, similarly to the conventional push button switch, the push button switch according to the present invention comprises a reinforcing plate 11, a membrane switch 12, a case 13, a key top 14 having an operation member **14*a*, a coil spring 16 serving as an elastic member for upwards urging the key top 14 in an initial stage and a coil spring 17 press-fitted in the operation member 14*a* of the key top 14**. Then, the characteristics of the push button switch according to the present invention will be described.

That is, the essential characteristic of the present invention lies in a moving member 15 disposed between the operation member **14*a* of the key top 14 and a first projection wall 13*a* of the case 13. A fastening claw 14*b* is formed at the lower end portion of the operation member 14*a* of the key top 14, the fastening claw 14*b* being formed movably within a groove 15*a* formed in a movable member 15. A stopper portion 15*b* for stopping the upward separation of a fastening claw 14*b* is formed at the top end portion of the movable member 15, while a fastening claw 15*c*, which is arranged to be engaged to a stopper portion 13*b* formed in a first projecting wall 13*a*, is formed at the lower end portion of the movable member 15. The fastening claw 15*c* is structured in such a manner that it can move within a groove 13*c* formed in the projecting wall 13*a*. A pair of fastening claws 14*c* is formed in the lower portion of the key top 14 at a position corresponding to the position at which a cut portion 13*e* is formed in a second projecting wall 13*d* so that the upward separation of the key top 14** is prevented.

When the key top 14 is depressed, the key top 14 is moved downwards against the urging force of the coil spring 16 serving as an elastic member which gives an upward urging force. At this time, the fastening claw **14*b* of the operation member 14*a* is moved downwards within the groove 15*a* formed in the movable member 15 until a lower surface 14*d* of the key top 14 comes in contact with the upper surface of the movable member 15. As a result, the fastening claw 15*c* of the movable member 15 moves within the groove 13*c*. Therefore, the outer surface of the operation member 14*a* moves along the inner surface of the first projecting wall 13*a* of the case 13. An upper sheet 12*b* of a membrane switch 12 is pressed by the bottom portion of the coil spring 17 fastened to the operation member 14*a*, causing a movable contact 12*a* to be brought into contact with a fixed contact 12*c*. As a result, the push button switch is switched on. Simultaneously, a lower surface 14*d* of the key top 14 is brought into contact with the upper surface of the first projecting wall 13*a*. When the pressure which is being applied to the key top 14 is released, the original state is restored by the elastic restoring force of the coil spring 16**.

In a comparison made between the structure according to the present invention and the conventional structure, the thickness b of the key top 14 and the thickness c of each of the reinforcing plate 11 and the membrane switch 12 are the same as those according to the conventional structure. The difference will now be described.

It is assumed that the distance of the movement of the lower surface 14d of the key top 14 to come in contact with the top end portion of the first projecting wall 13a can be expressed by S. Furthermore, it is also assumed that each of the distance between the lower surface 14d of the key top 14 and the upper surface of the movable member 15 and the distance from the upper surface of the movable member 15 and the first projecting wall 13a is expressed by ½S. In addition, it is assumed that the distance between the lower surface of the operation member 14a of the key top 14 and the lower surface of the movable member 15 and the distance between the lower surface of the movable member 15 and the bottom surface of the case is ½S. Also assuming that the length between the top surface of the first projecting wall 13a and the lower surface (the fastening portion) of the movable member 15 is E, the overall height of the push ,button switch is expressed by $H=3/2\ S+E$, therefore, $E=H-3/2\ S$.

On the other hand, the same relationship according to the conventional push button switch can be expressed by $H=2S+a$, therefore $a=H-2S$ (however, the thickness of the key top 14 and the thickness c of each of the reinforcing plate 11 and the membrane switch 12 are excluded from the above-described equation since they are the same for both the push button switches according to the present invention and the conventional structure). Then, the difference between the structure according to the present invention and the structure according to the conventional structure can be obtained by $E-a=H-3/2\ S-(H-2S)$, therefore $E=a+\frac{1}{2}\ S$. Therefore, assuming that the height H of the push button switch according to the present invention and the same according to the conventional;. push button switch are the same, the fastening portion E can be allowed to have a size larger than the conventional fastening portion a by the size of ½ S. Therefore, assuming that the distance of the movement is 3 mm, the fastening portion E can be arranged to have a size larger than the conventional fastening portion a by 1.5 mm. As a result, an effect can be obtained in that the key top 14 cannot be operated deflectively even if the edge of the key top 14 is depressed.

Another embodiments of the present invention will be described.

Figure 3:
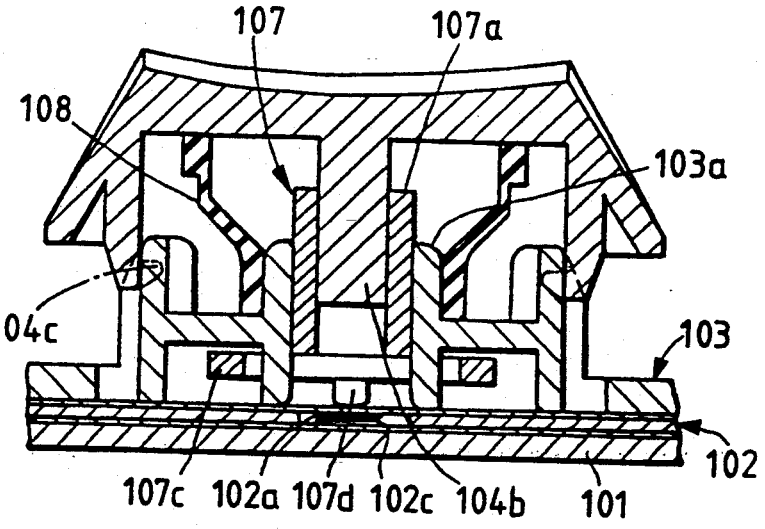
FIGS. 3 and 4 are cross sectional views which respectively illustrate the push button switch in a non-operated state and viewed from different directions.
Figure 4:
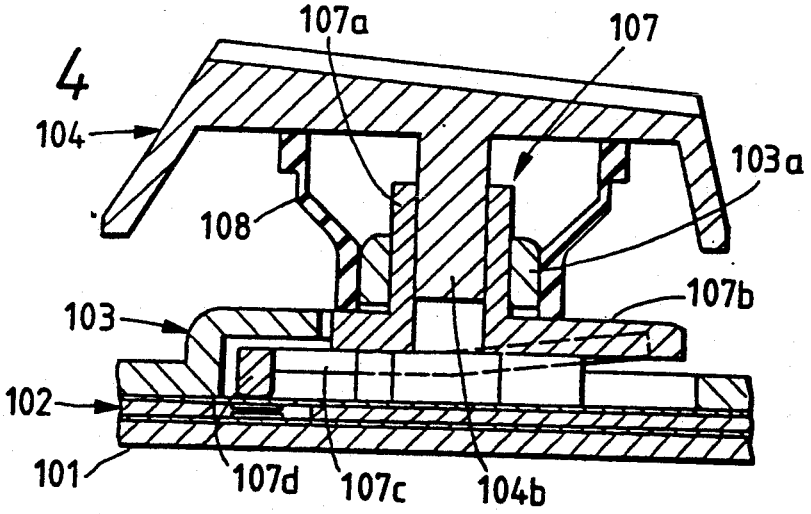
Figure 5:
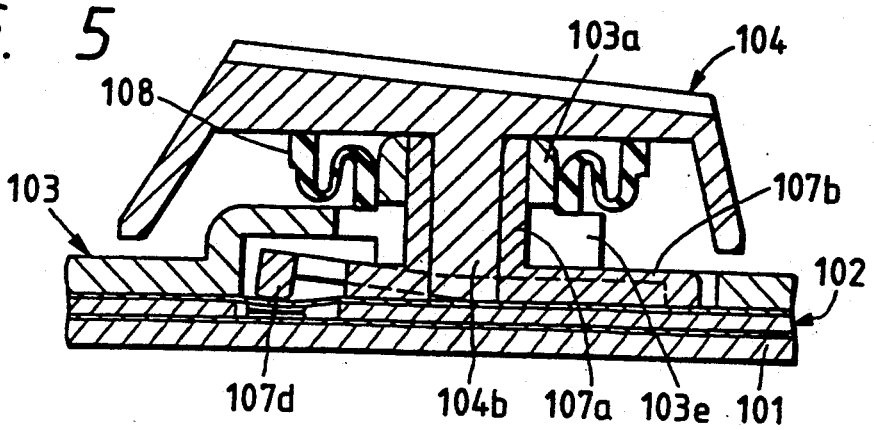
FIG. 5 is a cross sectional view which illustrates the push button switch in the depressed state.
Figure 6:
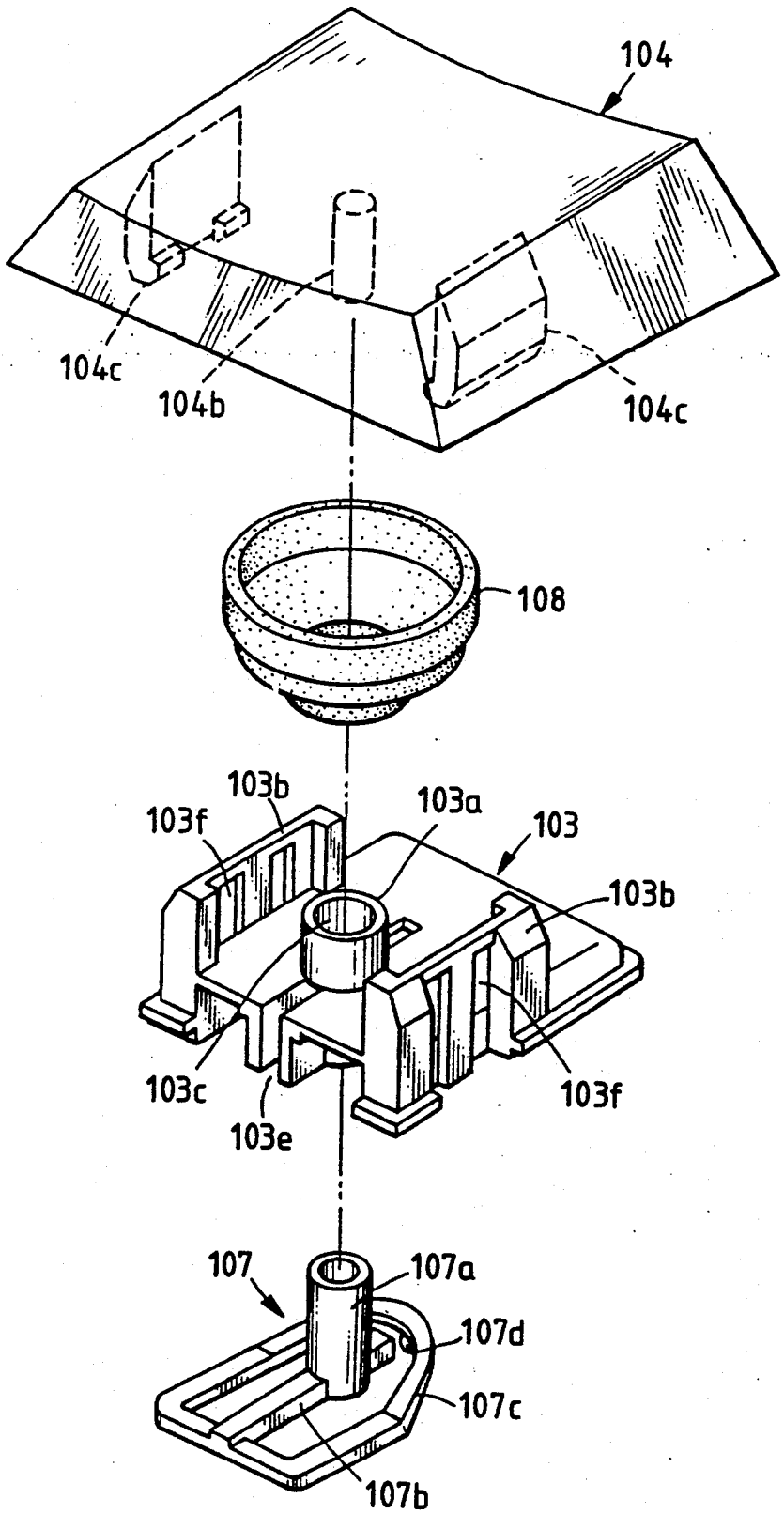
FIG. 6 is an exploded perspective view which illustrates the push button switch.

FIGS. 3 and 4 are cross sectional views which respectively illustrate the push button switch according to a second embodiment of the present invention when viewed from different directions. FIG. 5 is a cross sectional view which illustrates the state where the push button switch according to the second embodiment of the present invention is being depressed. FIG. 6 is an exploded perspective view of the same.

Referring to the drawings, reference numeral 107 represents an actuator comprising a hollow cylindrical portion 107a, a connecting portion 107b horizontally extending from the lower portion of the cylindrical portion 107a and an elastic member 107c in the form of a D-figure in a plan view and integrally formed with an end portion of the connecting portion 107b. A projection 107d for pressing the contact portion of a membrane 102 is formed in the elastic member 107c. The above-described cylindrical portion 107a is movably inserted into an inner wall 103c of a guide cylinder 103a of a housing 103. The above-described connecting portion 107b is inserted into a guide groove 103e formed in the housing 103, the guide groove 103e being formed in such a manner that it crosses the guide cylinder 103a. Furthermore, the above-described elastic member 107c is disposed in a space formed between the housing 103 and the membrane switch 102.

The ceiling of the key top 104 has a rod-like stem 104b and and fastening claws 104c confronting each other with respect to the stem 104b, the stem 104b and the fastening claws being so formed as to extend downwards. The stem 104b is movably inserted into the cylindrical portion 107a of the actuator 107 until it comes in contact with the top end portions of respective grooves 103f formed in projections 103b. As a result, the separation of the key top 104 from the housing 103 can be prevented. Furthermore, a click rubber 108 serving as the restoring member is disposed between the housing 103 and the key top 104. The click rubber 108 is arranged to be in the form of a downwards-tapered shape and has the top end large-diameter portion which is positioned so as to come in contact with the ceiling of the key top 104 and the lower end small-diameter portion which is fitted around the outer surface of the guide cylinder 103a. A reinforcing plate 101, a membrane switch 102 and the like are arranged to be the same as those according to the above-described conventional structure.

Then, the operation of the thus constituted push button switch will be described.

In a non operated state shown in FIGS. 3 and 4, the key top 104 is positioned at the uppermost position of the stroke at which the fastening claws 104c are positioned in contact with the corresponding grooves 103f by the elastic force of the click rubber 108. At this time, the membrane 102 is turned off since the cylindrical portion 107a of the actuator 107 is not pressed by the key top 104.

When the key top 104 is depressed by an operator against the elastic force of the click rubber 108, serving as a restoring member the click rubber 108 is turned over with a click as shown in FIG. 5 so that the key top 104 is moved downwards. In this case, the stem 104b is downwards moved in the cylindrical portion 107a until the ceiling of the key top 104 comes in contact with the top end portion of the cylindrical portion 107a. As a result, the cylindrical portion 107a is downwards moved along the inner surface 103c of the guide cylinder 103a. Corresponding to the downward movement of the connecting portion 107b due to the same downward movement of the cylindrical portion 107a, the elastic member 107c is gradually deflected so that the contact portion of the membrane switch 102 is pressed by the projection 107d. As a result, the push button switch is switched on.

When the above-described pressure is released from the key top 104, the key top 104 is upwards moved to the uppermost position in the stroke shown in FIG. 4 due to the elastic force generated by the click rubber 108 and the elastic member 107c. Therefore, the membrane switch 102 is switched off.

As described above, according to this embodiment, the actuator 107 is provided between the stem 104b of the key top 104 and the guide cylinder 103a of the housing 103, the actuator 107 being able to move with respect to the stem 104b and the guide cylinder 103a. Therefore, the distance of the movement can be doubled in comparison to the conventional structure arranged in such a manner that the stem is moved along the guide cylinder in directly contact with each other. That is, the necessary height of the push button switch can be shortened with the smooth movement maintained to that obtainable from the conventional structure. Furthermore, the diameter of the stem 104b and that of the guide cylinder 103a can be reduced with respect to the diameter according to the conventional structure arranged in such a manner that the coil spring is used since the contact portion of the membrane switch 102 is pressed by the elastic member 107c integrally formed with the actuator 107. Therefore, a space capable of accommodating the click rubber 108 serving as the restoring member can be secured outside the guide cylinder 103a. As a result, the size of the push button switch can be reduced.

Figure 7:
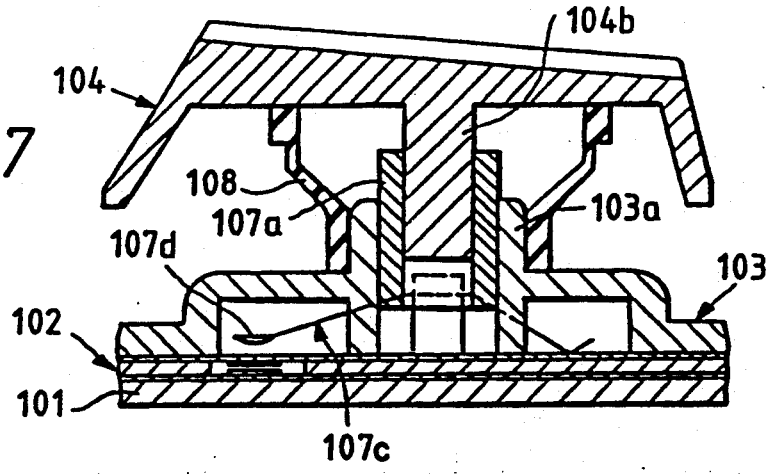
FIG. 7 is a cross sectional view which illustrates a third embodiment of the push button switch according to the present invention.
Figure 8:
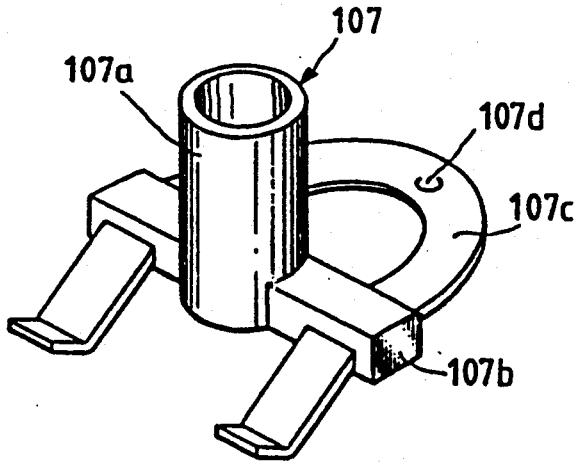
FIG. 8 is a perspective view which illustrates an actuator provided for the push button switch shown in FIG. 7.

FIG. 7 is a cross sectional view which illustrates the non-operated state of the push button switch according to a third embodiment of the present invention. FIG. 8 is a perspective view which illustrates the actuator provided for the push button switch shown in FIG. 7. Referring to the drawings, the elements which are the same as those shown in FIGS. 3 to 6 are given the same reference numerals.

The difference between this embodiment and the second embodiment lies in that the actuator 107 is constituted by fitting the elastic member 107c made of a metal elastic plate so as to surround the connecting portion 107b made of synthetic resin. The other structure and the operation are the same as those according to the second embodiment.

Figure 9:
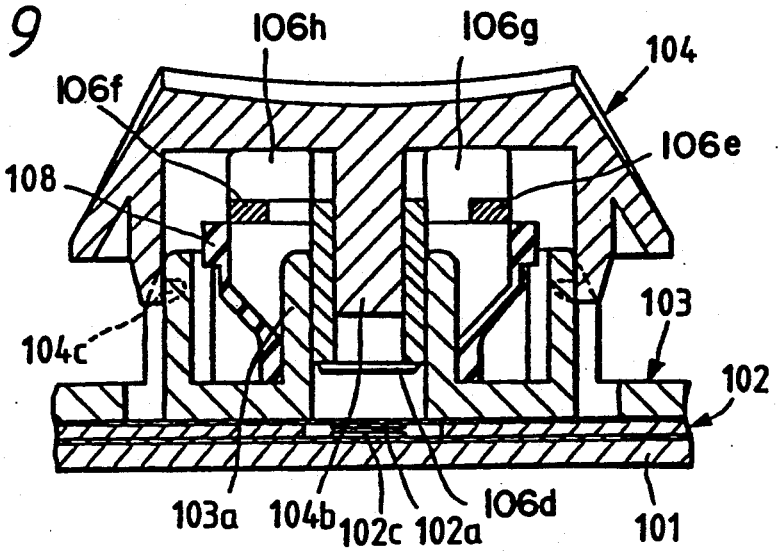
Figure 10:
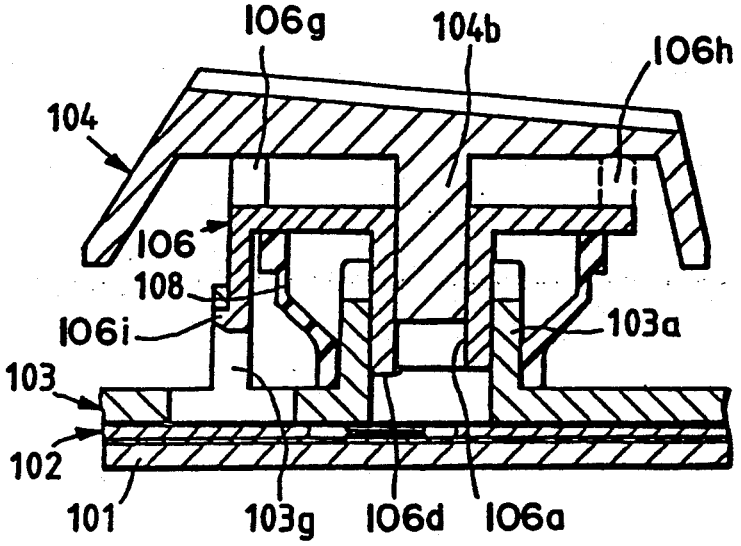
Figure 11:
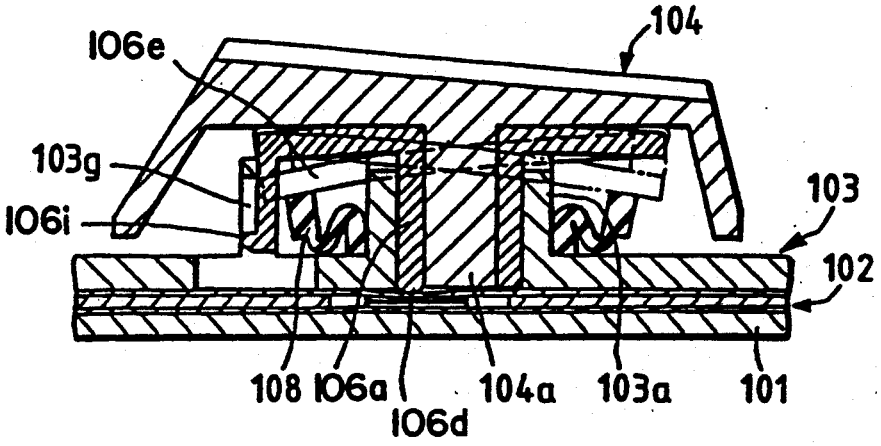
Figure 12:
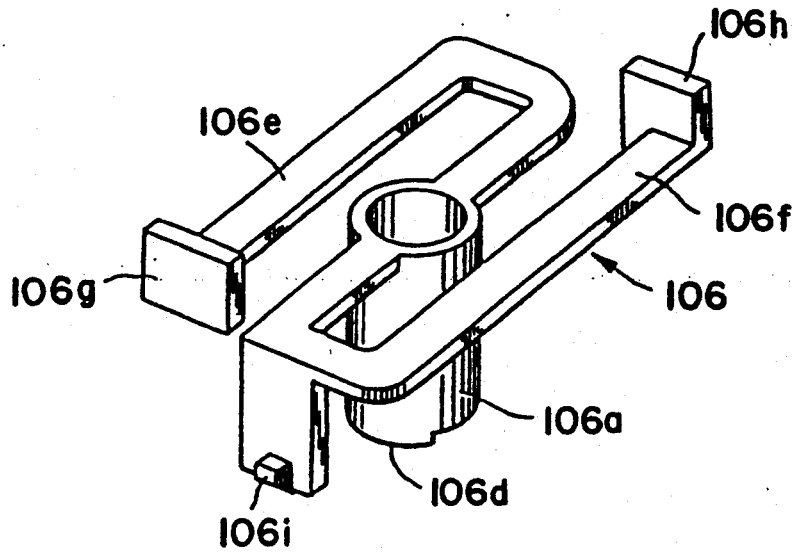
Figure 13:
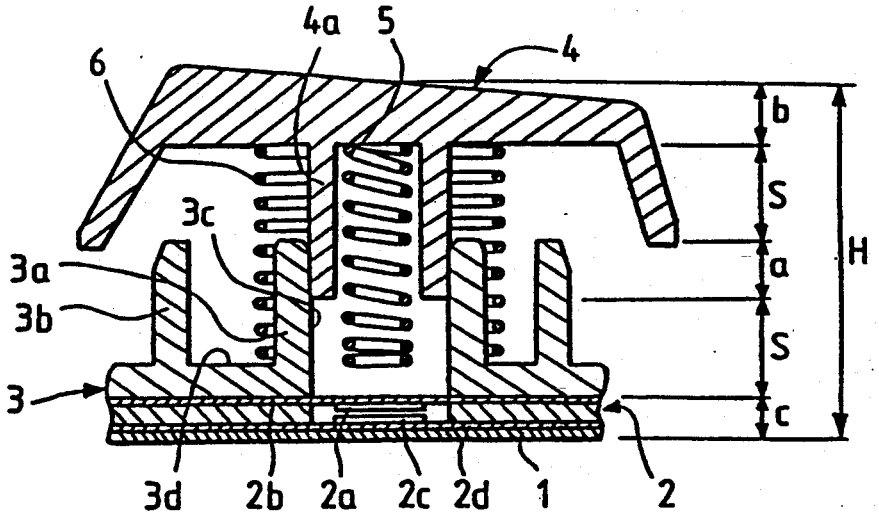
FIG. 13 PRIOR ART
FIG. 13 is a cross sectional view which illustrates a conventional push button switch.

FIGS. 9 and 10 are cross sectional views which illustrate the push button switch according to a fourth embodiment of the present invention when viewed from different directions. FIG. 11 is a cross sectional view which illustrates a state where the push button switch according to this embodiment is being operated. FIG. 12 is a perspective view which illustrates the actuator provided for the push button switch according to this embodiment. The same elements as those shown in FIGS. 3 to 6 are given the same reference numerals.

According to this embodiment, the actuator 106 comprises the hollow cylindrical portion 106a having the projection 106d at the lower end portion thereof, first and second legs 106e and 106f in the form of a crank and extending into opposite directions to each other from the top end portion of the cylindrical portion 106f, fastening portions 106g and 106h formed at the front end portions of the first and the second legs 106e and 106f and a stopper member 106i hung from a portion of the second leg 106f. The click rubber 108 is disposed between the housing 103 and the two legs 106e and 106f so as to elastically urge the fastening portions 106g and 106h against the ceiling the key top 104. The above-described stopper member 106i is arranged so as to be capable of vertically moving in a stopper groove 103g formed in the housing 103. As a result, the separation of the actuator 106 from the housing 103 can be prevented. The other structure according to this embodiment is the same as that according to the second embodiment. Therefore, its description is omitted here.

When the key top 104 is depressed by an operator from the non-operated state shown in FIGS. 9 and 10, the cylindrical portion 106a is moved downwwards along the inner surface of the guide cylinder 103a so that the click rubber 108 is turned over. Then, as shown in FIG. 11, the stem 104b is downwards moved along the inner surface of the cylindrical portion 106a so that the first and the second legs 106e and 106f are deflected. Thus, the contact portion of the membrane switch 102 is pressed by the projection 106d due to the resilience of the first and the second legs 106e and 106f so that the push button switch is switched on. When the above-described pressure applied to the key top 104 is released, the key top 104 is upwards moved to the uppermost position in the stroke shown in FIG. 10 due to the elastic force generated by the click rubber 108 and the two legs 106e and 106f. As a result, the membrane switch 102 is switched off.

In addition to the effect obtainable from the above-described second embodiment, an effect can be obtained according to the fourth embodiment in that an erroneous operation of contacts due to the dimensional error or deformation can be prevented since the projection 106d integrally formed with the lower end portion of the cylindrical portion 106a presses the contact portion of the membrane switch 102. Furthermore, since the stopper member 106i for preventing the separation of the actuator 106 from the housing 103 is provided for the actuator, the housing 103, the actuator 106 and the click rubber 108 can be previously prepared in the form of a semifinished products. Therefore, the assembling work can be facilitated.

According to the above-described second to the fourth embodiments, the click rubber 108 is employed as the member for restoring the key top 104. However, the present invention is not limited to this. A coil spring may be employed as an alternative to the click rubber 108 for forming a push button switch of a non-click type.

As described above, the push button switch according to the first embodiment of the present invention has the movable member 15 disposed between the case 13 and the key top 14. Therefore, the length of the fastening portion can be lengthened by a length corresponding to the half of the distance of the movement if the height of the push button switch and the distance of the movement of the push button switch are arranged to be the same as those according to the conventional push button switch. As a result, even if the edge of the key top 14 is depressed, the key top 14 is not depressed deflectively. Consequently, the push button switch can be satisfactorily smoothly depressed.

Furthermore, according to the push button switch according to the second to the fourth embodiments of the present invention, the height of the push button can be reduced with the distance of the movement maintained. In addition, the diameter of the guide cylinder and the stem can be reduced. Therefore, a compact push button switch also having a reduced thickness can be provided.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A push button switch comprising:

a fixed contact and a movable contact:

a base member having a guide cylinder;

a key top having a stem;

a restoring member for upwards urging said key top;

an actuator having upper and lower end portions disposed between said guide cylinder and said stem so as to be able to move with respect to said guide cylinder and said stem, wherein a pressing portion for pressing said movable contact to contact with said fixed contact is formed in the lower end portion of said actuator, and at least one elastic leg which is arranged to come in contact with said key top is formed in the upper end portion of said actuator so as to be deflected when said key top is depressed.

2. A push button switch according to claim 1, wherein an engaging portion is provided in said base member, and said actuator comprises a hollow cylindrical portion having an outer wall which moves on the surface of said guide cylinder and an inner wall which moves said stem, first and second elastic legs extending from the upper end portion of said cylindrical portion to confront said key top, and a stopper portion which is engaged to said engaging portion.

3. A push button switch according to claim 2, wherein said first and second legs are in the shape of a crank and extend in opposite directions to each other from the upper end portion of said cylindrical portion of said actuator.

4. A push button switch according to claim 1, wherein a fastening portion is formed at the front end of said at least one elastic leg to contact said key top.

5. A push button switch according to claim 1, wherein said restoring member is disposed between said base member and the leg of said actuator so as to be deflected when said key top is depressed.

6. A pushbutton switch comprising:

switch elements;

a housing having a guide cylinder with a top end;

a key top having a stem projected from a inner top surface, adapted to move up and down along said guide cylinder;

a restoring member for biasing said key top upwards; and an actuator having an elastic members extending from a root section thereof, provided between said housing and said key top, slidable with respect to said guide cylinder and said stem, and adapted to drive said switch elements by pressure; said guide cylinder having at the top end recessed cutouts into which said actuator may be inserted with freedom of movement, said actuator being lowered and inserted into said cutouts so as to drive said switch elements by pressure as said key top is lowered against the elasticity of said restoring member.

7. A pushbutton switch as claimed in claim 6, wherein said key top and the actuator are at their lower end of the stroke when said pushbutton is depressed, said top end surface of said guide cylinder is set at a level lower than the lower end of the stroke of said inner top surface, and the inner bottom surfaces of recessed cutouts of the guide cylinder of said housing are set at a level lower than the lower ends of the strokes of the elastic member of said actuator.

* * * * *